US005384556A

United States Patent [19]

Coles et al.

[11] Patent Number: 5,384,556

[45] Date of Patent: Jan. 24, 1995

[54] MICROWAVE CIRCULATOR APPARATUS AND METHOD

[75] Inventors: Mark E. Coles, Marlboro; James P. Kingston, Natick, both of Mass.

[73] Assignee: Raytheon Company, Lexington, Mass.

[21] Appl. No.: 129,709

[22] Filed: Sep. 30, 1993

[51] Int. Cl.[6] ..... H01P 1/387

[52] U.S. Cl. ..... 333/1.1; 333/246

[58] Field of Search ..... 333/1.1

[56] References Cited

U.S. PATENT DOCUMENTS

| | | | |
|---|---|---|---|
| 3,673,518 | 6/1972 | Carr | 333/1.1 |
| 3,739,302 | 6/1973 | McManus | 333/1.1 |
| 3,895,308 | 7/1975 | Lee et al. . | |
| 4,209,756 | 6/1980 | Jin et al. | 333/1.1 |
| 4,276,522 | 6/1981 | Coerver | 333/1.1 |
| 4,634,992 | 1/1987 | Brown | 330/47 |
| 4,703,289 | 10/1987 | Kwitkowski | 333/1.1 |
| 4,704,588 | 11/1987 | Kane | 333/1.1 |
| 4,749,965 | 6/1988 | Prevot et al. | 333/1.1 |
| 4,810,979 | 3/1989 | Morz et al. | 333/1.1 |
| 5,128,635 | 7/1992 | Vaughan et al. | 333/1.1 |

OTHER PUBLICATIONS

"Microwave Circulator Design," D. K. Linkhart, AR-TECH House, Inc. Norwood, Mass., International Standard Book Number 0-89006-329-X, Library of Congress Catalog Card Number 89-6550, 1989, pp. 37-40.

*Primary Examiner*—Paul Gensler

*Attorney, Agent, or Firm*—Walter F. Dawson

[57] ABSTRACT

A ferrite stripline circulator having low cost, broad tolerance elements and an easy to assembly design. The unit comprises of a cylindrical housing into which are stacked a ferrite disk, a center conductor, another ferrite disk, a metal ground plane, a disk magnet, a metal cover and a compression spring. A C-clip, that fits into a groove on an upper inner circumference of the cylinder, forces the compression spring against the cover and thereby applies the pressure that is required to assure proper operation of the stacked elements.

10 Claims, 3 Drawing Sheets

MICROWAVE CIRCULATOR APPARATUS AND METHOD

BACKGROUND OF THE INVENTION

This invention relates generally to microwave devices and in particular to a method and apparatus for assembling a low cost ferrite stripline circulator.

As is known in the art, energy transfer between two or more ports may be provided by non-reciprocal devices such as circulators and isolators. In particular with circulators, energy fed to an input port of the circulator is transferred to an output port of the circulator, whereas input energy fed to the output port of the circulator is not efficiently transferred to the input port of the circulator, and therefore, such a device is generally referred to as a non-reciprocal device. Such devices are used to minimize VSWR interactions between adjacent components or to duplex a common antenna between a transmitter and a receiver.

One type of circulator commonly employed in the art is a junction circulator which can be comprised of either a stripline transmission medium or microstrip transmission medium. The construction of a stripline circulator is shown in Microwave Circulator Design, Douglas K. Linkhart, Artech House, Inc., MA 1989, pages 37–39. A junction circulator typically comprises three ports and is generally referred to in the art as a Y-junction circulator. The basic construction of a stripline Y-junction circulator includes a center conductor having three stripline branches connected to a center portion. The center conductor is sandwiched between a pair of ferrite disks which space said center conductor from ground planes disposed over the second surfaces of the ferrite disks. Disposed over the second surfaces of the ground planes are permanent magnets which magnetically bias the ferrite. The ferrites are used to provide nonreciprocal performance via gyromagnetic action. Input energy fed to an input one of the branches of the circulator is transferred either to a clockwise disposed or counter-clockwise disposed adjacent output port of the circulator in accordance with the polarity of the magnetic field fed through the ferrite disks. Screw clamps, soldering or epoxy techniques usually hold the circulators together and in place.

Many microwave systems require ferrite circulators with stripline, microstrip or coaxial transmission line interfaces. Solid state phased array systems require large quantities of circulators (typically one to three per transmit/receive (T/R) module. In order to reduce system costs components that are used repetitively such as circulators are key targets for cost reduction. Prior art circulators have been implemented with solder joints, epoxy bonds or conventional fasteners which contribute to the circulator cost and they are not easily disassembled for rework without damage to the parts in a unit. Accordingly, there is a need for a simply assembled, low cost microwave ferrite circulator.

SUMMARY OF THE INVENTION

Accordingly, it is therefore an object of this invention to provide a low cost stripline circulator suitable for low, moderate or high volume production.

It is a further object of this invention to provide a low cost method for assembling a stripline circulator suitable for low, moderate or high volume production.

It is a further object of this invention to provide a microwave circulator comprising a housing means for supporting a plurality of elements of the circulator, first disk means disposed within the housing means for providing gyromagnetic action, center conductor means disposed on the first disk means, the center conductor means having a plurality of tabs, each of the tabs extending outside the housing means for providing ports for circuit connections, second disk means disposed on the center conductor means for providing the gyromagnetic action, a ground plane disposed on the second disk means, the circumference of the ground plane contacting the sides of the housing means, a magnet disposed on the ground plane, cover means disposed on top of the magnet for providing magnetic shielding, and means disposed on the cover means for compressing the plurality of elements disposed within the housing means. The housing means comprises a metal cylinder having a closed base, or the housing means comprises a metal cylinder having a closed base with a flange extending beyond the circumference of the cylinder walls for mounting the circulator. The first disk means and the second disk means comprises a ferrite material. The first disk means and the second disk means each comprises a ring having an inner portion comprising a ferrite material and an outer portion comprising a dielectric material. The center conductor means comprises a photochemically etched copper. The compressing means comprises spring means disposed on the cover means for providing a compression force to the plurality of elements of the circulator, and retainer means disposed on the spring means and positioned within a groove of the housing means for compressing the spring means.

It is a further object of this invention to provide a method for providing a low cost microwave circulator comprising the steps of providing a housing means for supporting a plurality of elements of the circulator, disposing a first disk means within the housing means adjacent to a bottom surface of the housing means for providing gyromagnetic action, disposing on the first ferrite disk means a center conductor means, the center conductor means having a plurality of tabs, each of the tabs extending outside the housing means for providing ports for circuit connection, disposing a second disk means on the center conductor for providing the gyromagnetic action, disposing a ground plane on the second disk means, the circumference of the ground plane being in contact with the sides of the housing means, positioning a magnet on the ground plane, placing a cover means on top of the magnet for magnetic shielding, and compressing the plurality of elements disposed within the housing means with means disposed on the cover means. The steps of disposing the first disk means and the second disk means in the housing means includes the first disk means and the second disk means each comprising ferrite material. The step of disposing the first disk means and the second disk means in the housing means includes the first disk means and the second disk means each comprises a ring having an inner portion comprising a ferrite material and an outer portion comprising a dielectric material. The step of disposing on the first ferrite disk a center conductor means comprises the step of photochemically etching copper to obtain the center conductor. The step of comprising the plurality of elements comprises the steps of disposing a spring means on the cover means for providing a compression force to the plurality of elements, and positioning a retainer means on the spring means and within a groove of the housing means for compressing the spring means.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
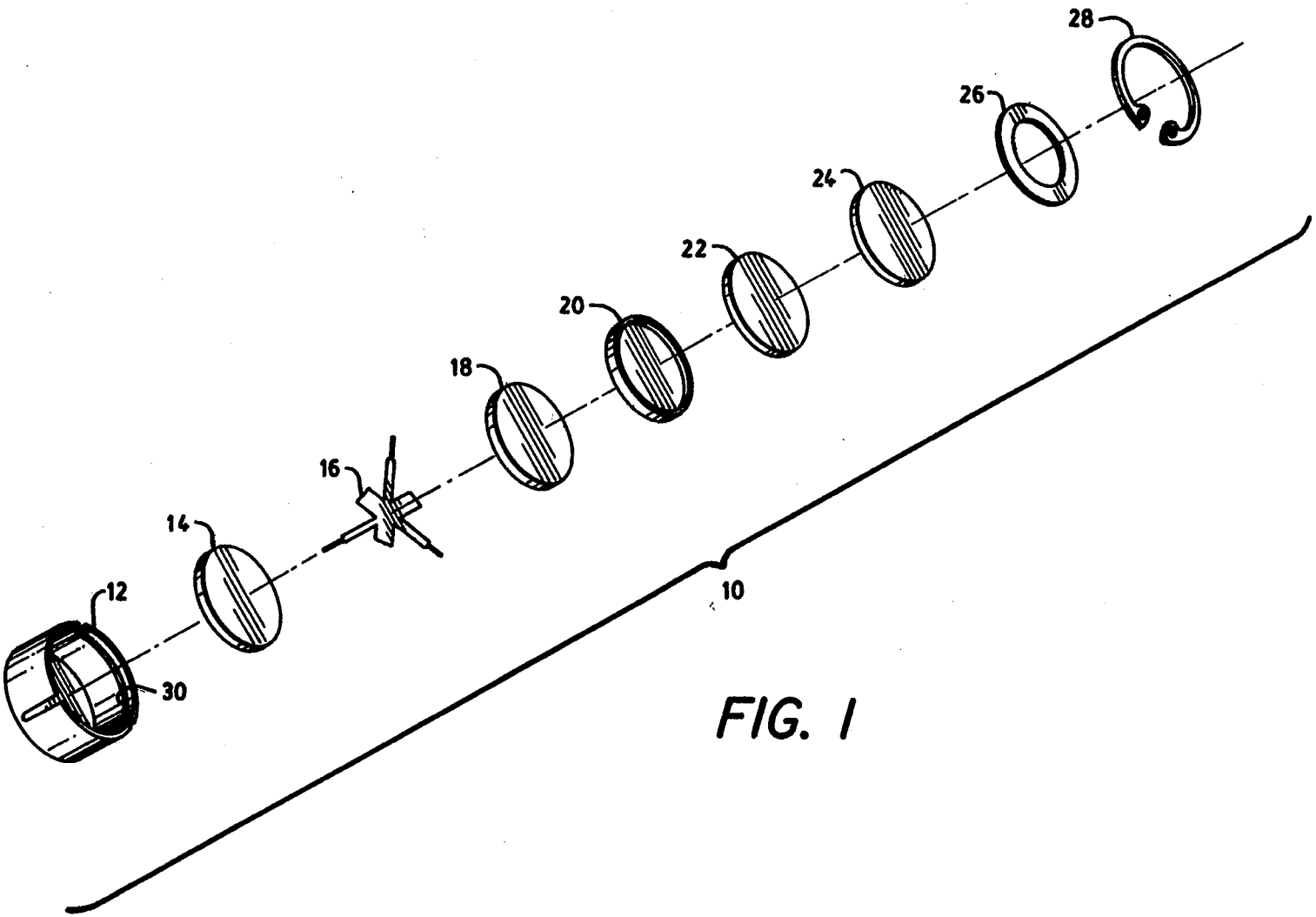
FIG. 1 is an exploded perspective of a ferrite stripline circulator according to the present invention showing the elements of said circulator.

Referring to FIG. 1 an exploded perspective view of a low cost stripline circulator 10 is shown. The circulator 10 comprises a housing 12 having a center conductor 16 sandwiched between two ferrite disks 14 and 18, a ground plane 20 disposed on the upper ferrite disk 18, a magnet 22 disposed on the ground plane 22, a cover 24 on top of the magnet 22, a compression spring 26 disposed on the cover 24, and a C-clip 28 inserted in a groove 30 on the upper inner circumference of the housing 12.

Figure 2:
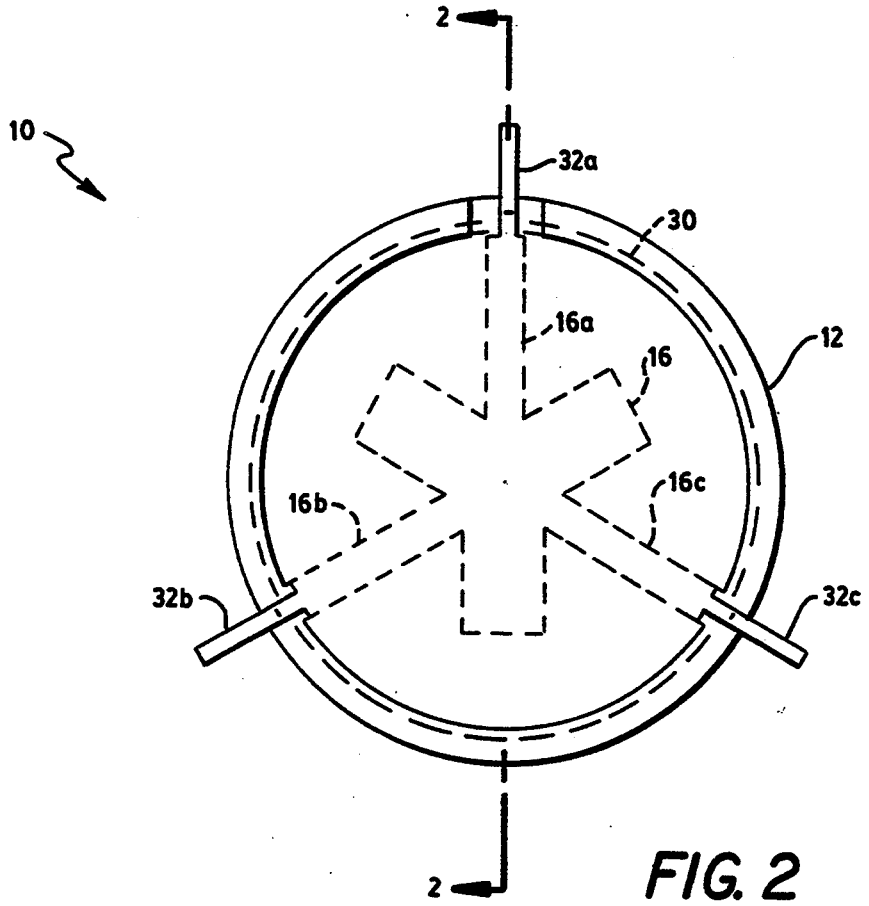
FIG. 2 is a plan view of a ferrite stripline circulator according to the present invention.

Referring now to FIG. 2, a plan view of a center conductor 16 used in the circulator 10 is shown. The center conductor 16 is photochemically etched without tight tolerances. The circulator 10 has three ports formed by three extension arms 16*a*–16*c* of the center conductor having tabs 32*a*–32*c* extending through slot openings 13*a*–13*c* in the cylindrical surface of the housing 12. The tabs 32*a*–32*c* facilitate soldering the circulator 10 into either a microstrip or stripline microwave printed circuit board.

Figure 3:
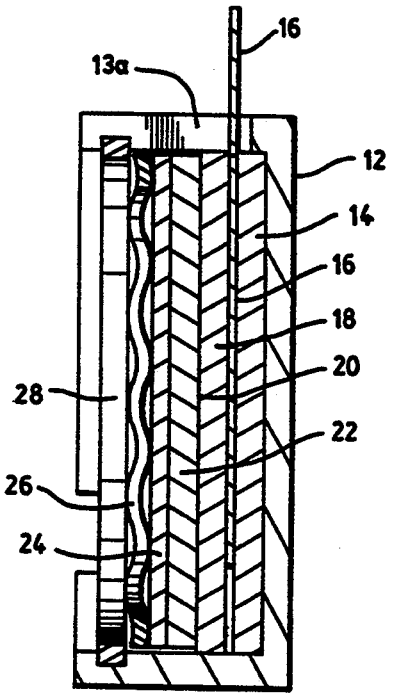
FIG. 3 is a cross-sectional view along line A—A of the ferrite stripline circulator of FIG. 2.

Referring now to FIG. 3, a cross-sectional view along line A—A of the circulator in FIG. 2 is shown. The housing 12 is a low cost, nickel plated, steel screw machine part cylindrical in shape and having three slot openings 13*a*–13*c* spaced at 120° intervals around the cylinder walls (13*b* and 13*c* are not shown). The ferrite disks 14, 18 are simple round disks having a diameter of 0.750±0.003 inches and a height of 0.045±0.005 inches which do not require a tight tolerance on the thickness dimension because the compression spring 26 absorbs tolerance effects. The center conductor 16 is photochemically etched from copper foil 0.005 inches thick. The ground plane 20 is a stamped metal piece of copper which folds up and contacts the wall of the cylindrical housing 12 over a large contact area. Both the center conductor 16 and the ground plane 20 are gold plated. The magnet 22 is circular shape with a diameter of 0.700±0.010 inches and thickness of 0.050±0.005 inches. The cover 24 is made of nickle plated cold rolled steel and is circular. The cover could be omitted in applications which allow some magnetic field to be created by the magnet 22. The compression spring 26 is disposed on the cover 24 and embodied by Part No. 9714K55 manufactured by McMaster-Carr Corporation of Alanta, Ga. The C-clip is embodied by Part No. 98409A181 manufactured by McMaster-Carr Corporation of Atlanta, Ga. Of particular import is that the circulator 10 is assembled without any epoxy bonding, solder joints or conventional fasteners and results in a circulator 10 that is easily disassembled and reworked without damage to the piece parts used in the circulator 10. Other relevant parameters of circulator 19 are given in Table 1.

TABLE 1

| Property | Value |
|---|---|
| Ferrite material | 64260 |
| Dielectric constant of Ferrite | 15.4 |
| Saturation magnetization | 550 Gauss |
| Center frequency | 3.3 GHz |
| Stripline height | 0.090 inches |
| Dielectric constant of ring | 20 |
| Magnet Material | Ceramic 5 |
| Dielectric Material | MCT 20 |
| Curie temperature of ferrite | 280° |
| 3 dB line width | 100 Oe |

Figure 4:
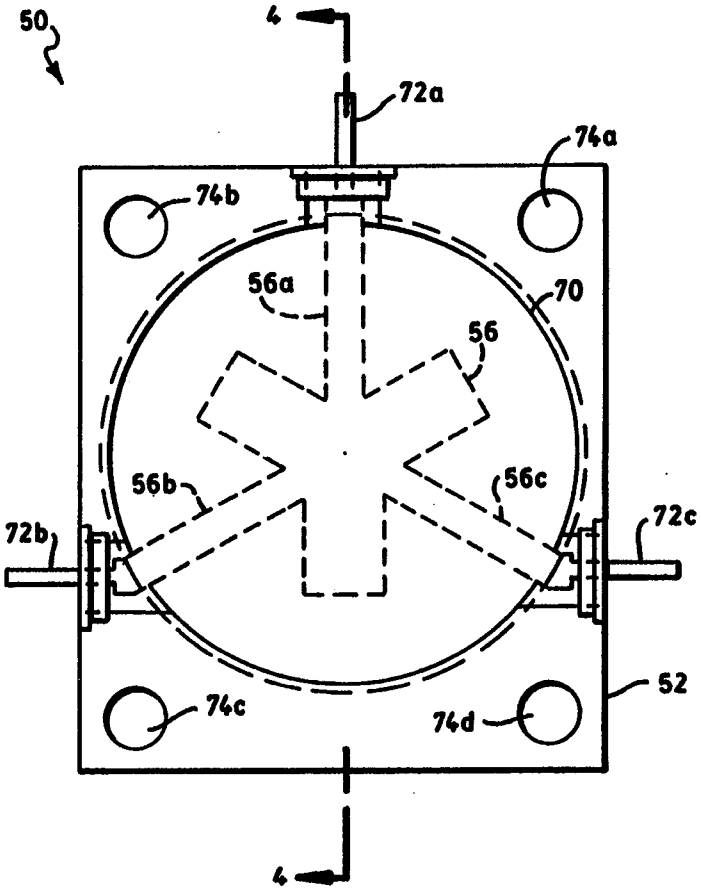
FIG. 4 is a plan view of an alternate embodiment of the invention showing a base with a rectangular flange and ferrite disk having a ferrite center portion surrounded by a dielectric ring outer portion.

Referring now to FIG. 4 an alternate embodiment of the invention is shown which comprises a different configuration for enabling the installation of a circulator 50 in an application requiring a housing 52 to have a rectangular base portion with four mounting holes 74*a*–74*d*. The outside dimensions of the rectangular base portion of housing 50 are 1.00 inches long by 0.85 inches wide. The four mounting holes 74*a*–74*d* are located at the four corners. The upper portion of the housing 52 is cylindrical having the same dimensions as the housing 12 in FIG. 2. The center conductor 56 has extension arms 56*a*–56*c* and two of such arms 56*b* and 56*c* are angled at the cylindrical wall of housing 52 to permit the tabs 72*b* and 72*c* to protrude through slot openings 53*b* and 53*c* in the cylindrical walls of the housing 52 equally spaced at 120° intervals. The extension arm 56*a* comprises tab 72*a* which protrudes straight through its slot opening 53*a* in the cylindrical wall. This alternate embodiment further comprises a C-clip 68 (not shown) which is inserted in a groove 70 on the upper inner circumference of the cylindrical portion of housing 52 to assure proper operation of the stacked components in conjunction with a compression spring 66 (not shown).

Figure 6:
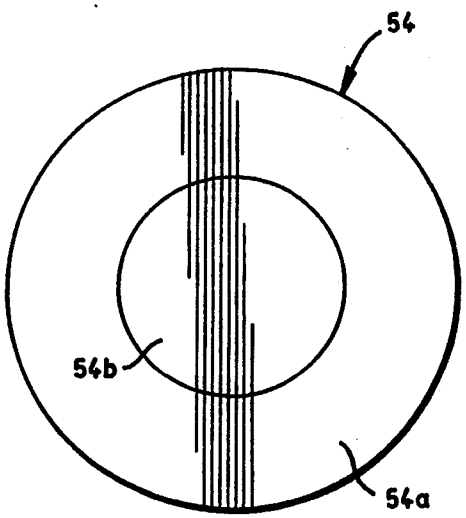
FIG. 6 is a plan view of the ferrite disk of the alternate embodiment shown in FIG. 5.
Figure 5:
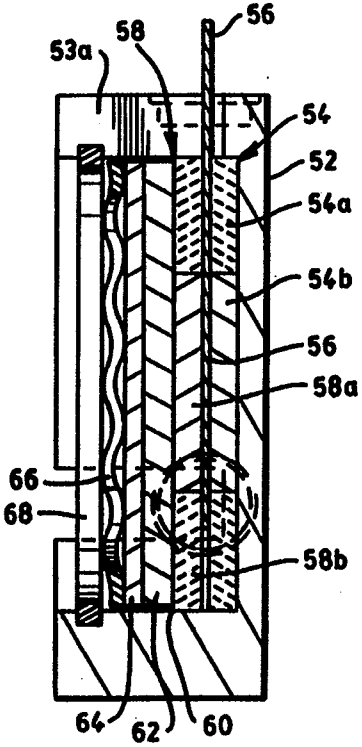
FIG. 5 is a cross-sectional view along line B—B of the alternate embodiment of FIG. 4.

Referring to FIG. 5 and FIG. 6, FIG. 5 shows a cross-sectional view along line B—B in FIG. 4 of the alternate embodiment. The housing 52 comprises a center conductor 56 sandwiched between two ferrite disks 54, 58, a ground plane 60 disposed on the upper ferrite disk 58, a magnet 62 disposed on the ground plane 60, a cover 64 disposed on top of the magnet 62, a compression spring 66 disposed on the cover 64, and a C-clip 68 inserted in, the groove 70 on the upper inner circumference of the housing 52. FIG. 6 is a plan view of one of the ferrite disks 54, 58. The ferrite disks 54, 58 in the alternate embodiment comprises a circular ferrite material 54*b* within a dielectric ring 54*a*. The ferrite material 54*b* has a diameter of 0.493 inches and the diameter of the complete ferrite disk 54, 58 is 0.75 inches. The dielectric ring 54*a* of the ferrite disks 54, 58 is embodied with Model MCT-20 ceramic from Trans-Tech of Adamstown, Md. This type of ferrite disk 54, 58 in a circulator 50 results in reduced losses for broadband applications. Other relevant parameters of circulator 50 are the same as in Table 1.

This concludes the description of the preferred embodiment. However, many modifications and alterations will be obvious to one of ordinary skill in the art without departing from the spirit and scope of the inventive concept. Therefore, it is intended that the scope of this invention be limited only by the appended claims.

What is claimed is:

1. A microwave circulator comprising:

a housing means for supporting a plurality of elements of said circulator;

first disk means disposed within said housing means for providing gyromagnetic action;

center conductor means disposed on said first disk means, said center conductor means having a plurality of tabs, each of said tabs extending outside said housing means for providing ports for circuit connections;

second disk means disposed on said center conductor means for providing said gyromagnetic action;

a ground plane disposed on said second disk means, the circumference of said ground plane contacting the sides of said housing means;

a magnet disposed on said ground plane;

cover means disposed on top of said magnet for providing magnetic shielding;

spring means disposed on said cover means for providing a compression force to said plurality of elements of said circulator; and retainer means disposed on said spring means and positioned within a groove of said housing means for compressing said spring means.

2. The microwave circulator as recited in claim 1 wherein said housing means comprises a metal cylinder having a closed base.

3. The microwave circulator as recited in claim 1 wherein said housing means comprises a metal cylinder having a closed base with a flange extending beyond the circumference of said cylinder walls for mounting said circulator.

4. The microwave circulator as recited in claim 1 wherein said first disk means and said second disk means comprises a ferrite material.

5. The microwave circulator as recited in claim 1 wherein said first disk means and said second disk means each comprises a ring having an inner portion comprising a ferrite material and an outer portion comprising a dielectric material.

6. The microwave circulator as recited in claim 1 wherein said center conductor means comprises a photochemically etched copper.

7. A method for providing a low cost microwave circulator comprising the steps of:

providing a housing means for supporting a plurality of elements of said circulator;

disposing a first disk means within said housing means adjacent to a bottom surface of said housing means for providing gyromagnetic action;

disposing on said first disk means a center conductor means, said center conductor means having a plurality of tabs, each of said tabs extending outside said housing means for providing ports for circuit connection;

disposing a second disk means on said center conductor for providing said gyromagnetic action;

disposing a ground plane on said second disk means, the circumference of said ground plane being in contact with the sides of said housing means;

positioning a magnet on said ground plane;

placing a cover means on top of said magnet for magnetic shielding;

disposing a spring means on said cover means for providing a compression force to said plurality of elements; and positioning a retainer means on said spring means and within a groove of said housing means for compressing said spring means.

8. The method as recited in claim 7 wherein said steps of disposing said first disk means and said second disk means in said housing means includes the step of said first disk means and said second disk means each comprising ferrite material.

9. The method as recited in claim 7 wherein said step of disposing said first disk means and said second disk means in said housing means includes the step of said first disk means and said second disk means each comprises a ring having an inner portion comprising a ferrite material and an outer portion comprising a dielectric material.

10. The method as recited in claim 7 wherein said step of disposing on said first disk a center conductor means comprises the step of photochemically etching copper to obtain said center conductor.

* * * * *